US009363594B2

(12) United States Patent
Azmi et al.

(10) Patent No.: US 9,363,594 B2
(45) Date of Patent: Jun. 7, 2016

(54) EARBUD WITH MEMBRANE BASED ACOUSTIC MASS LOADING

(71) Applicant: Apple Inc., Cupertino, CA (US)

(72) Inventors: Yacine Azmi, San Jose, CA (US); Scott P. Porter, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/297,477

(22) Filed: Jun. 5, 2014

(65) Prior Publication Data

US 2015/0172800 A1 Jun. 18, 2015

Related U.S. Application Data

(60) Provisional application No. 61/915,851, filed on Dec. 13, 2013, provisional application No. 61/923,126, filed on Jan. 2, 2014.

(51) Int. Cl.

| | |
|---|---|
| ***H04R 25/00*** | (2006.01) |
| ***H04R 1/28*** | (2006.01) |
| ***H04R 1/10*** | (2006.01) |

(52) U.S. Cl.

CPC ..... *H04R 1/2807* (2013.01); *H04R 1/1016* (2013.01)

(58) Field of Classification Search

CPC ..... H04R 1/1016; H04R 1/1091
USPC ..... 381/380–385, 373, 370
See application file for complete search history.

(56) References Cited

U.S. PATENT DOCUMENTS

| | | | | |
|---|---|---|---|---|
| 2,463,762 | A * | 3/1949 | Giannini | H04R 1/342 181/125 |
| 4,742,887 | A * | 5/1988 | Yamagishi | H04R 1/2857 181/129 |
| 5,331,062 | A | 7/1994 | Sorathia et al. | |
| 6,417,251 | B1 * | 7/2002 | Brady | C08F 6/20 521/40 |
| 6,543,573 | B2 | 4/2003 | Ishihara et al. | |
| 7,321,742 | B2 | 1/2008 | Fujishiro et al. | |
| 8,179,024 | B2 | 5/2012 | Boström | |

(Continued)

FOREIGN PATENT DOCUMENTS

| | | | |
|---|---|---|---|
| JP | 08172691 | A * | 7/1996 |
| WO | WO-2012061594 | A2 | 5/2012 |

OTHER PUBLICATIONS

"Dynamic Mechanical Analysis (DMA)", Frequently Asked Questions, A Beginner's Guide, PerkinElmer, Waltham, MA, USA, Copyright 2008-2013, (pp. 1-23)—Admitted Prior Art.

(Continued)

*Primary Examiner* — Curtis Kuntz
*Assistant Examiner* — Julie X Dang
(74) *Attorney, Agent, or Firm* — Blakely, Sokoloff, Taylor & Zafman LLP

(57) ABSTRACT

An in-ear earphone housing has a speaker driver installed therein. The driver has a diaphragm with a front face and a rear face, and a motor to vibrate the diaphragm in accordance with an audio signal. A back volume chamber is positioned behind the driver within the earphone housing. The diaphragm is part of a wall of the back volume chamber. An acoustic mass loading membrane that is part of a wall of the back volume chamber, and that is to vibrate in response to acoustic waves produced by vibration of the diaphragm impinging on a front face of the membrane, is provided. Other embodiments are also described and claimed, including a polymer production process for an elastic material.

18 Claims, 4 Drawing Sheets

(56) References Cited

U.S. PATENT DOCUMENTS

| | | | | |
|---|---|---|---|---|
| 8,189,851 | B2 | 5/2012 | Booth et al. | |
| 8,284,964 | B2 | 10/2012 | Windischberger et al. | |
| 8,526,652 | B2 | 9/2013 | Ambrose et al. | |
| 8,532,325 | B2 * | 9/2013 | Tung | H04R 1/2811 381/338 |
| 2005/0094843 | A1 * | 5/2005 | Soto-Nicolas | H04R 1/225 381/423 |
| 2005/0123159 | A1 * | 6/2005 | Matsuoka et al. | 381/312 |
| 2008/0298623 | A1 | 12/2008 | Klein et al. | |
| 2009/0220113 | A1 * | 9/2009 | Tiscareno | H04R 1/403 381/309 |
| 2009/0247244 | A1 * | 10/2009 | Mittleman | H04M 1/035 455/575.1 |
| 2009/0323995 | A1 * | 12/2009 | Sibbald | H04R 1/227 381/337 |
| 2010/0224437 | A1 * | 9/2010 | Booth et al. | 181/166 |
| 2010/0261023 | A1 | 10/2010 | Ravnaas | |
| 2010/0291045 | A1 | 11/2010 | Jia et al. | |
| 2012/0070022 | A1 | 3/2012 | Saiki | |

OTHER PUBLICATIONS

Sichina, W. J., "Prediction of Polymer Damping Properties Using the Diamond DMA and Master Curves", Thermal Analysis, application note, PETech-88, PerkinElmer™ Instruments, Waltham, MA, USA, (5 pages)—Admitted Prior Art.

"An Acoustic Mass (Inertance)", Admitted Prior Art—http://www.music.mcgill.ca/~gary/618/week8/node7.html, McGill Copyright 2004-2013 McGill University, (2 pages).

Calvert, J. B., "Acoustic Circuits: Pipes and Resonators", Admitted Prior Art—http://mysite.du.edu/~jcalvert/waves/acoucirc.htm, Created Sep. 16, 2003, Last revised Jan. 20, 2009, (15 pages).

* cited by examiner

EARBUD WITH MEMBRANE BASED ACOUSTIC MASS LOADING

RELATED MATTERS

This non-provisional application claims benefit of the earlier filing dates of U.S. Provisional applications 61/915,851 filed Dec. 13, 2013 and 61/923,126 filed Jan. 2, 2014.

An embodiment of the invention is related to improving the sound produced by loose-fitting (leaky) in-ear earphones (earbuds). Another embodiment of the invention relates to techniques for manufacturing an elastic material from which a membrane can be made. Other embodiments are also described.

BACKGROUND

An earbud is an earphone that is to be partially inserted into the outer ear canal. When seeking to improve the acoustic bass response of a loose fitting, earbud-type speaker driver, an acoustic bass tuning tube (that is open to the atmosphere) can be added that connects to a back volume chamber of the driver. The back volume chamber is separated from a front volume chamber by the diaphragm of the driver, and contains a volume of air inside the earbud housing that is open to the rear face of the driver diaphragm. The tuning tube provides the needed, equivalent acoustic mass loading to the driver, so as to lower the frequency of the driver's resonance, to thereby yield an extended low frequency or bass response. This is effective for improving bass response when there is acoustic leakage that is due to the loose fit of the earbud.

SUMMARY

One problem that may arise in the context of an earbud is that the back volume and the bass tuning tube together may take up too much space. An embodiment of the invention aims to solve this problem by using a membrane to achieve equivalent acoustic mass loading of the driver. The membrane, which may be passive, i.e. not driven by an actuator or motor, is in effect part of a wall that defines the back volume chamber for the driver. One side of the membrane is inside the chamber while the other side is open to the atmosphere, e.g. through a vent hole or air passage in the earbud housing, or through a much larger opening. The opening may be as large as the area of the membrane. The vent hole, air passage or larger opening may be covered by an acoustically transparent protective mesh (so as to physically protect the otherwise exposed membrane). The membrane should be engineered in terms of its composition, elasticity, and size so as to exhibit a desired vibration response (to the sound waves emanating from the rear face of the diaphragm) in order to achieve a desired equivalent acoustic mass loading against the diaphragm such that the bass region of the earbud's acoustic response is extended. An advantage here is that the bass tube may not be needed, thereby freeing up space in the earbud housing or yielding a lower-profile earbud, while at the same time achieving a desired equivalent acoustic mass loading of the driver diaphragm.

An embodiment of the invention is a method for manufacturing an elastic material from which a membrane (such as the one described above as used for acoustic mass loading) can be made. The method involves providing a target damping characteristic which specifies that damping exhibited by the membrane be a) greater than a first target, while the membrane is vibrating below its first or fundamental vibration mode frequency, and b) less than a second target while vibrating above the first vibration mode frequency. In one embodiment, the material contains a particular combination of one or more additives to a polymer material, e.g. silicone, polyurethane, rubber, that causes the material to exhibit increased damping (e.g., increased dissipation factor or increased tan delta) below the first vibration mode frequency, and reduced damping above the first vibration mode frequency.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
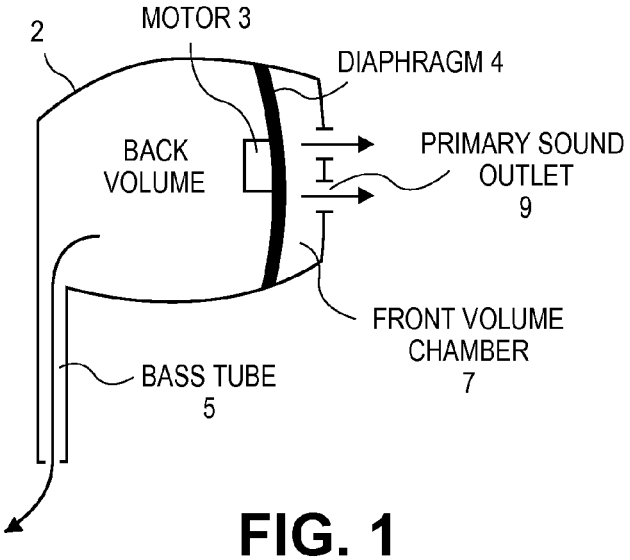
FIG. 1 depicts an earbud-type earphone that is fitted with an acoustic tuning bass tube.

FIG. 1 depicts an earbud-type earphone that is fitted with an acoustic tuning bass tube 5. In one embodiment, a housing 2 is designed to be partially inserted, at a primary sound outlet 9, into the ear canal of a user. The entirety of the housing 2 may be rigid and as such the earphone is designed to be a leaky or loose fitting against the ear canal, rather than a fully sealed type which often has a more flexible or resilient ear tip to create a seal against the ear canal wall. The housing 2 contains a speaker driver having a motor 3 connected to a compliant diaphragm 4, where a front face of the diaphragm is open to a front volume chamber 7 in the housing 2. The front volume allows sound waves produced by vibration of the diaphragm 4 to be emitted from the primary sound outlet. The diaphragm 4 separates the housing into the front volume chamber 7 and a back volume chamber 6 that is described as being "behind" the diaphragm 4. As such, the diaphragm 4 can be said to form a part of a wall of the back volume chamber 6. The back volume is connected to the atmosphere through an acoustic tuning or bass tube as shown, which, as explained above in the Background section, can be used to extend the low frequency response of the earphone, improving bass response for the wearer or user of the earphone.

Figure 2:
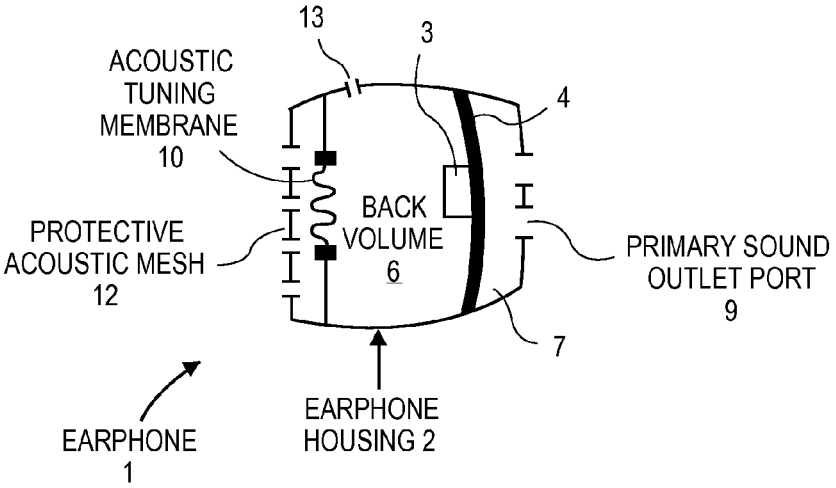
FIG. 2 is a block diagram in a section view of an earbud-type earphone with an acoustic tuning membrane.

Turning now to FIG. 2, this figure is a block diagram and a section view of an earbud-type earphone 1 that is fitted with an acoustic tuning, compliant membrane 10. The earphone 1 may be part of a wired headset or a wireless headset. The bass tube in this case may be essentially removed (or is not needed), since the desired acoustic mass loading that is presented to the vibrating diaphragm (using the back volume chamber 6) is achieved by the addition of the acoustic tuning membrane 10. The membrane 10 as seen can be defined as part of a wall of the back volume chamber 6 (see FIG. 1 for a similar arrangement but without the membrane 10), so that the membrane vibrates in response to acoustic waves produced by vibration of the diaphragm 4, where the waves come off of the rear face of the diaphragm and impinge on a front face of the membrane 10. By appropriately selecting the size, elasticity and damping characteristics of the acoustic tuning membrane 10, a desired acoustic mass loading of the driver is achieved, without the need for an additional bass tube, thereby freeing up potentially valuable space in a low profile earphone housing 2. Note, however, that while the bass tube is no longer necessary, it may be added if desired to obtain additional tuning ability. It should be noted here that while FIG. 1 and FIG. 2 depict the diaphragm 4 as being oriented vertically, an alternative is to orient the driver so that the diaphragm is oriented horizontally, or angled between the horizontal and the vertical.

Figure 3:
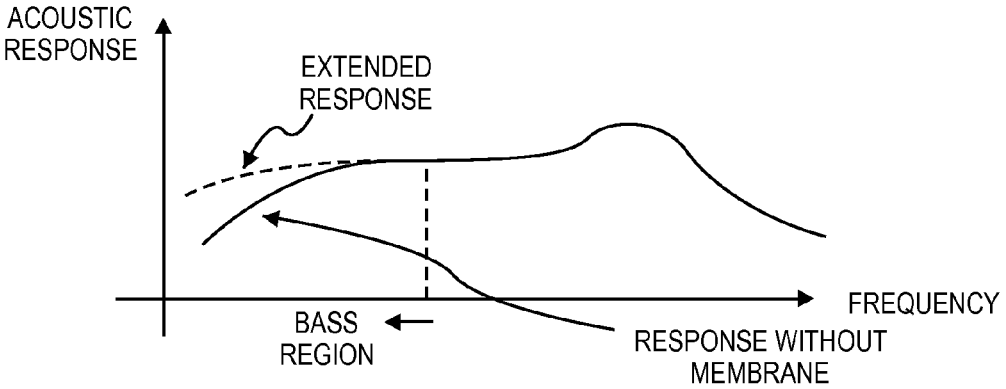
FIG. 3 shows example acoustic response curves of an earbud with and without an acoustic tuning membrane.

In one embodiment, the membrane 10 provides acoustic mass loading in that a low frequency acoustic response of the driver is extended, as compared to when the membrane is absent. An example of such a finding is shown in FIG. 3, where it can be seen that in the bass region, the acoustic response is extended in that the response curve exhibits a greater amplitude or magnitude, in comparison with the response curve obtained without the membrane 10. The bass region may be the region below 400 Hz.

Figure 4:
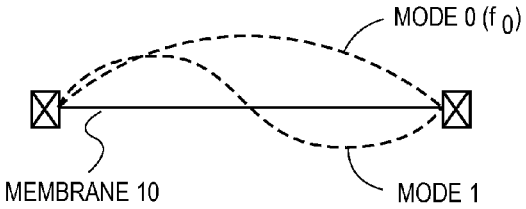
FIG. 4 is a conceptual section view of an example acoustic tuning membrane that has uniform thickness and is made of the same material throughout, showing low order vibration modes.

In one embodiment, the membrane 10 exhibits a lowest normal vibration mode, natural frequency, or fundamental vibration or resonance frequency $f_0$ that is between 20 Hz to 100 Hz. This initial vibration mode is depicted in FIG. 4, in the case of an example of the membrane 10 having a uniform thickness and uniform material or composition that is being secured at its periphery. Mode 0 is the fundamental vibration or resonance mode having a frequency $f_0$, while mode 1 is the next higher (frequency) vibration mode. Of course, the membrane 10 may also vibrate in higher order modes during normal operation of the earbud speaker driver.

The equivalent acoustic mass that is imparted by the membrane 10 may be approximated by the following expression $$M_{acoustic} = \frac{M_{mechanicalmass}}{SurfaceArea^2}$$

It should be noted that, advantageously, the membrane 10 serves to extend bass response by essentially providing more acoustic mass or more acoustic loading at low frequencies than at high frequencies. A reason why the membrane 10 has less impact at high frequencies may be because, in one embodiment, it is selected to be relatively thin and made of lightweight materials, therefore having a very small mechanical mass. The acoustic loading of the driver is performed both acoustically and by mechanical modification of the driver in such a way as to have less impact at high frequencies. As a result, it exhibits less acoustic resistance at high frequencies—see, for example, the example response curves in FIG. 3, where the amplitude acoustic response above the bass region is depicted as being essentially unaffected by the addition of the membrane. The membrane 10 is particularly advantageous in an in-ear earphone which is leaky (not fully sealed), and where the membrane 10 operates in the full audio range in that the driver receives a full audio band signal. As such, the membrane 10 may vibrate across the full audio range.

Figure 5:
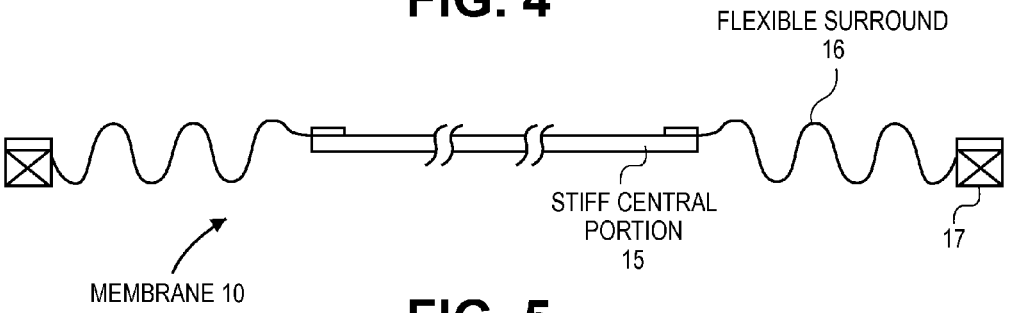
FIG. 5 is a section view of another example of the acoustic tuning membrane, having a stiff central portion and a flexible surround.

Turning now to FIG. 5, in accordance with another embodiment of the invention, the membrane 10 may be designed so as to suppress or limit its displacement in higher order vibration modes. In such an embodiment, the membrane 10 has a stiff central section or portion 15, and a flexible annular section or surround 16 that abuts the central portion 15 along the entirety of its periphery. The flexible surround 16 is affixed, along its entire periphery, to a wall of the back volume chamber 6 (see FIG. 2). The wall of the back volume chamber 6 in effect defines a fixed or rigid peripheral region 17, rigid relative to the compliant membrane 10. The central portion 15 is allowed to move by virtue of the compliance in the flexible surround 16, in relation to the fixed region 17. By having a stiffer central portion, while the compliance of the membrane 10 is primarily due to its surround or periphery portion, the frequency of mode 1 (see FIG. 4) and higher order modes is increased. This is desirable because the higher order vibration modes may cause undesirable artifacts (or ripple) in the frequency response of the earphone as a whole, within the audible range.

The flexible surround 16 may be a ring made of a relatively resilient material, such as a silicone, and may also have a non-uniform shape, e.g. corrugated as shown. In contrast, the stiff central portion 15 may be, for example, an aluminum plate or cone. Using some numbers as an example, the Young's Modulus of the material that makes up the flexible surround 16 may be in the range of 0.5-10 mega pascals, while the Young's Modulus of the stiff central portion 15 may be in the range of 40-70 giga pascals. The flexibility or resilience or compliance in the flexible surround 16 is needed so as to push the resonant frequency $f_0$ of the membrane 10 as a whole downward, which is more desirable in order to provide an extended bass response.

Figure 6:
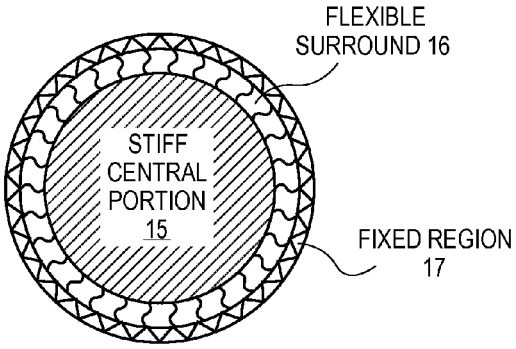
FIG. 6 is a top view of the membrane of FIG. 5.

As seen in FIG. 5 and FIG. 6, the membrane 10 in that case is substantially circular, e.g. a perfect circle, elliptical or oval. As an alternative, other shapes are possible. In terms of surface area or size, for the case of a circular membrane, the active area, which is defined as the area inward of the fixed region 17 (see FIG. 6), may have a diameter of less than 20 mm. This makes it small enough to fit within a typical earphone housing 2 of an in-ear earphone or earbud. As a practical matter, it is expected that in such an application, the membrane 10 should have a diameter of at least 5 mm. It should be recognized that the membrane 10 may not produce sound that can be heard by a user, but rather it is for acoustic tuning of the sound that is produced by the diaphragm 4 of the driver, by virtue of providing an acoustic mass loading using the back volume chamber 6. This purpose may dictate the material properties including the elasticity given above.

As shown in FIG. 2, the earphone housing 2 may need a barometric relief vent or pinhole 13, to allow pressure on opposite faces of the diaphragm 4 to equalize during altitude changes. In one embodiment, a barometric relief vent or pinhole may be formed in the acoustic tuning membrane 10 if desired (while the membrane 10 is airtight otherwise). However, such a hole should not acoustically "short" the membrane 10. In order to maintain displacement efficiency of the membrane 10 at resonance, the pinhole should be effectively limited to well below the lowest resonance frequency of the membrane 10. In other words, the pinhole should be very small so as not to acoustically short the response of the membrane 10 at its fundamental vibration frequency or resonance $f_0$.

Although not shown in FIG. 2, in one embodiment, an acoustic tuning vent may be added into a rigid portion of the wall of the back volume chamber 6, that communicates with the atmosphere. Such a vent may be used to, for example, reduce the magnitude of the driver's acoustic response at a frequency above the fundamental $f_0$, and perhaps even above the bass region, while acting primarily as a resistive port.

Still referring to FIG. 2, in one embodiment of the invention, an acoustic network that is acoustically open to a rear face of (or is located "behind") the membrane 10 can be provided, for purposes of further acoustic tuning of the response of the driver. In one embodiment, a protective acoustic mesh 12 is added as shown, that fully encloses the rear face of the membrane 10, while allowing the membrane 10 to be open to the atmosphere in an acoustically tuned manner. The mesh 12 may, for example, provide acoustic damping or acoustic resistance, while at the same time serving to physically protect the membrane 10 from intrusions outside of the housing 2.

Figure 7:
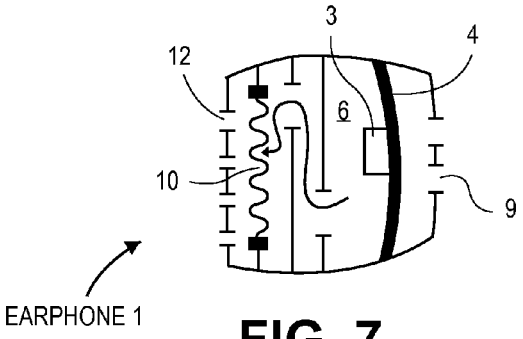
FIG. 7 is a conceptual section view of another embodiment of an earphone having an acoustic tuning membrane.

Turning now to FIG. 7, this is a cross-section view of another embodiment of the earphone 1, where in this case the back volume chamber 6 is not a completely uninterrupted open space in its entirety (between the diaphragm 4 and the membrane 10), but rather contains an air canal (with a path there through as indicated by the curving arrow). The air canal may be formed by the addition of at least two segments or baffles extending inward from rigid portions of the wall of the chamber 6 as shown. In one embodiment, a cross-section area or transverse surface area along the entirety of such an air canal, that connects the diaphragm 4 of the driver to the membrane 10, is no smaller than ten percent (10%) of the total vibrating surface area of the membrane 10.

Another embodiment of the invention relates to techniques for manufacturing an elastic material from which a membrane can be made. Elastic materials such as those based on a polymer, e.g. rubber and silicone, can be specified for custom manufacture using a number of parameters. Such parameters include any chemical compatibility requirements (such as exposure to oils or fuels), physical characteristics including whether the material should be hard or soft, environmental exposure (such as ozone resistance), and a product life expectancy in a specified working environment.

In the field of acoustic damping materials that are suitable for sound proofing of wall and ceiling panels in buildings, the material may be tested for its ability to damp vibrations in modes 1, 2 and 3. That testing procedure associates a damping parameter with each vibration mode, which damping parameter can be measured using known techniques. Mode 1 is the fundamental vibration mode of the long dimension of a test panel that is made of the desired material, while mode 2 is the second order mode of the long dimension, and mode 3 is the fundamental mode of the narrow dimension of the panel. An accelerometer is placed in the center of the panel, and the panel is struck, while the resulting impulses are recorded by the accelerometer and saved. The impulse response can then be analyzed using a Fourier transform technique, in order to identify the three vibration modes, and in particular to identify the damping factors associated with each mode. The viscosity of the material can be adjusted using various additives. By varying the solid content of such additives, the frequency of a resonance mode changes. These techniques focus on evaluating whether or not a particular damping parameter becomes smaller or larger, as a function of different additives. The acoustic damping composition can be specified to have a minimum damping parameter at mode 1, or a minimum damping parameter at mode 2, etc. where a larger damping parameter indicates better (more desirable) sound absorption capability.

Figure 8:
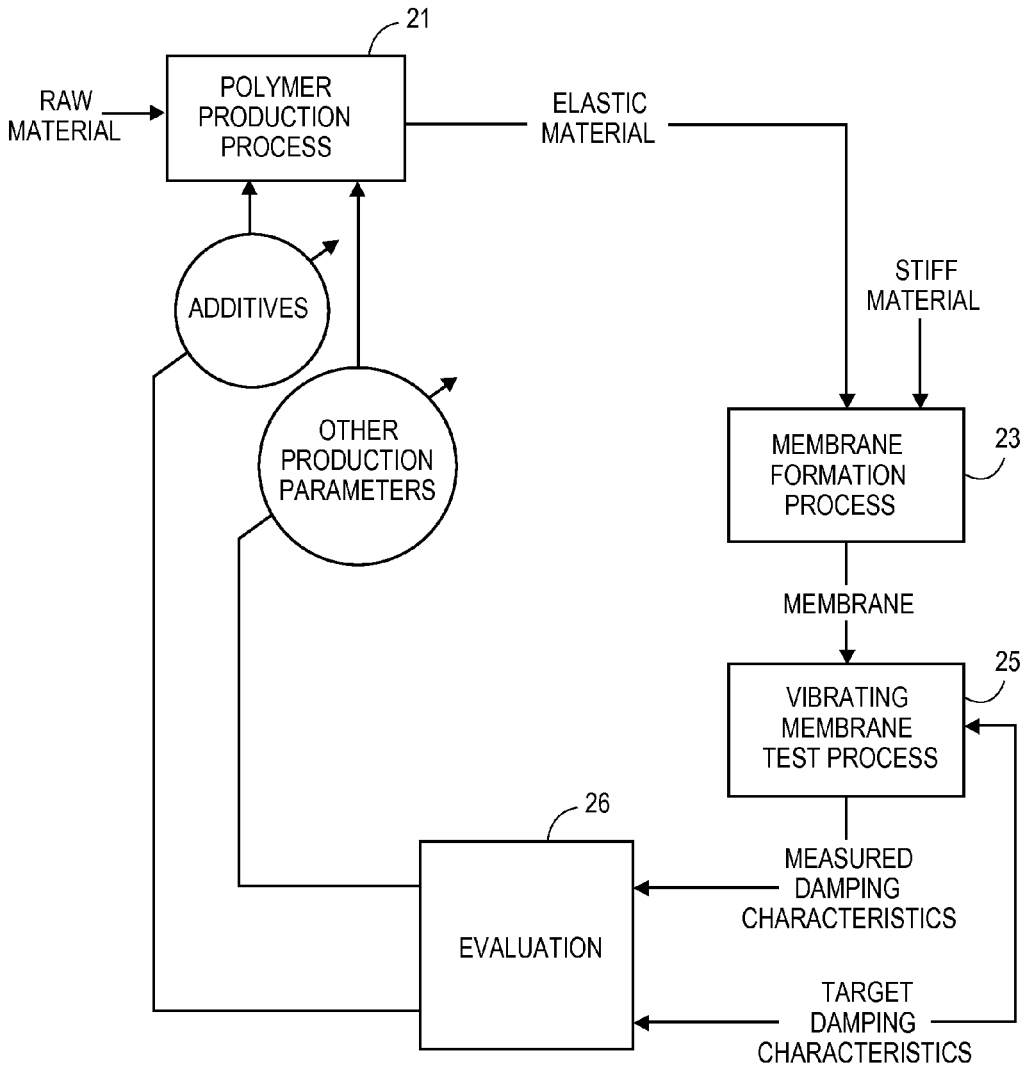
FIG. 8 is a process flow diagram of a method for making an elastic material.

FIG. 8 is a flow diagram of a method for manufacturing an elastic material, in accordance with an embodiment of the invention. Feeding it with raw materials, e.g. a polymer such as silicone, rubber, or polyurethane, a polymer production process 21 is performed that results in an elastic material being produced. This may be a conventional process. The raw material may be essentially a silicone polymer to which one or more additives may be added as shown. In one embodiment, the production process 21 involves vulcanizing the polymer.

The elastic material that is yielded by the production process 21 is then used to form a test membrane (block 23). In one embodiment, the test membrane may be generally circular and may have a uniform thickness, being made entirely of the elastic material. This may be the membrane 10 described above in connection with FIG. 4, which depicts the first two vibration modes of such a membrane in dotted lines. The first vibration mode frequency is essentially that of fundamental vibration mode (0,1), for example, of a circular membrane. Alternatively, the test membrane may have a stiff central portion, e.g. an aluminum plate or cone, attached to and surrounded by a resilient surround or suspension element, where the latter is made entirely of the elastic material—see FIG. 5 and FIG. 6. The resilient surround imparts the needed compliance to enable vibration of the membrane 10.

Figure 9:
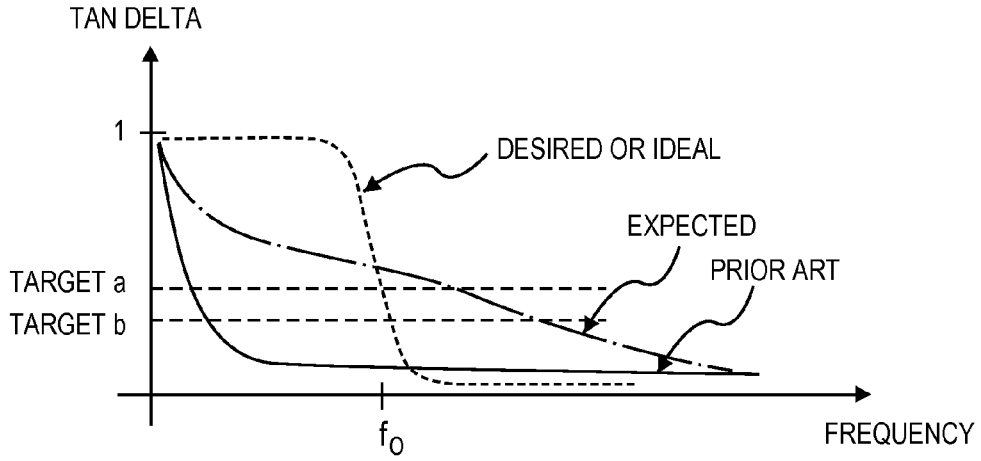
FIG. 9 shows three curves representing damping factor tan delta vs. frequency of a vibrating membrane, namely a desired or ideal curve, a prior art curve for an example existing material, and an expected curve for an improved material.

Returning to the flow diagram of FIG. 8, a force is then applied to the test membrane that causes the membrane to vibrate, and then a damping characteristic of the vibrating membrane is measured, as part of a test process 25. The test process 25 is conducted to measure a damping characteristic of the vibrating test membrane, for example using any suitable conventional technique, e.g. Direct Mechanical Analysis (DMA) by Perkin Elmer Inc., Waltham Mass. The expected behavior of an example membrane is shown in FIG. 9, adjacent to a desired or ideal behavior. The behavior may be defined, and measured, in terms of an energy dissipation parameter (damping characteristic), such as tan delta. In that case, one or both of the first and second targets may be given as tan delta values, where a greater tan delta value indicates greater energy dissipation (or damping). Other energy dissipation parameters can be used to define the behavior of a vibrating test membrane. The test membrane is expected to meet a target damping characteristic which specifies that damping exhibited by the membrane be a) greater than a first target (e.g., target a), while the membrane is vibrating below its first vibration mode frequency $f_0$, and b) less than a second target (e.g., target b) while vibrating above the first vibration mode frequency $f_0$. While FIG. 9 shows target a and target b as being different, they may instead be equal.

Still referring to FIG. 8, a comparison is performed between the measured and the target damping characteristics, as part of an evaluation process block 26. This can be performed either entirely by one of ordinary skill in the art (of elastic material production), or with the help of a programmed computer that stores a list of different elastic material specimens or batches that have been previously produced and tested, including which additives and production parameters were used to make each batch. The production process is then repeated based on having controlled or adjusted an amount or type additive or, for making the next specimen. Other production parameters may also be modified (based on the results of the evaluation process 26). The process loop described above and shown in FIG. 8 is repeated as needed until a specimen is found that meets the target damping characteristics.

Figure 10:
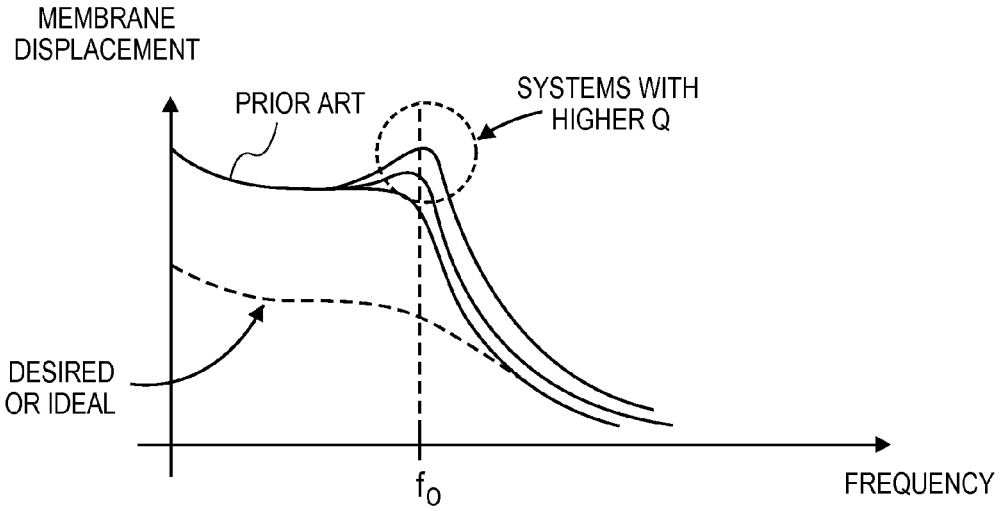
FIG. 10 shows curves representing membrane displacement vs. frequency of a vibrating membrane, including curves for an example existing material and a desired or ideal curve.

In one embodiment, the production process is controlled by changing the composition of the elastic material, e.g. by controlling an additive in the composition, so as to 1) maximize damping (as exhibited by a test membrane that is made using the material) below the first vibration mode frequency $f_0$, 2) minimize damping above the first vibration mode frequency, or 3) both maximize damping below the first vibration mode frequency and minimize damping above the first vibration mode frequency. For example, the target damping characteristic may specify tan delta>0.1, or tan delta>0.5, everywhere below 50 Hz. In another embodiment, membrane displacement can be measured vs. frequency of vibration. A displacement vs. frequency curve for a desired membrane, relative to the curves of several conventional membranes, is shown in FIG. 10. The composition of the membrane's elastic material may be controlled by adjusting the amount or type of an additive, to meet a target damping characteristic and/or a target displacement behavior.

In one embodiment, a method for manufacturing an elastic material comprises producing an elastic material using a polymer production process, and controlling the production process in order to meet a target damping characteristic which specifies that damping exhibited by a membrane made using the produced elastic material be maximized below a first vibration mode frequency of the membrane. For example, the target dampening characteristic may specify tan delta>0.1 below 50 Hz. The target damping characteristic may further specify that damping exhibited by the membrane be minimized above the first vibration mode frequency. The production process may control composition of the material, by controlling an additive in the composition to meet the target damping characteristic. Control of the composition of the material may comprise changing the composition to minimize the damping, exhibited by a membrane made using the material, above the first vibration mode frequency. The first vibration mode frequency may be essentially that of fundamental vibration mode (0, 1) of a circular membrane. Production of the elastic material may comprise vulcanizing a polymer. The polymer or may be silicon, rubber, or polyurethane. In one embodiment, the elastic material may be essentially silicone.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the test membrane depicted in FIG. 4 was described as generally circular, the test membrane may alternatively have a different shape (e.g., elliptical). As another example, in most instances, the combination of the motor 3 and the diaphragm 4 of FIG. 2 and FIG. 7 is expected to be a moving coil electro-dynamic driver. However, in some instances, the membrane-based acoustic mass loading techniques described above could be used with other types of sound producing transducers. The description is thus to be regarded as illustrative instead of limiting.

What is claimed is:

1. An earphone comprising:

an in-ear earphone housing having a sound outlet port;

a speaker driver installed in the housing, the driver having a diaphragm with a front face and a rear face, and a motor to vibrate the diaphragm in accordance with an audio signal;

a back volume chamber within the earphone housing, wherein the rear face of the diaphragm is part of a wall of the back volume chamber;

a front volume chamber within the earphone housing, wherein the front face of the diaphragm opens to the front volume chamber and the front volume chamber is acoustically coupled to the sound outlet port; and an acoustic mass loading membrane that is part of another wall of the back volume chamber and that is to vibrate in response to acoustic waves, produced by vibration of the rear face of the diaphragm, impinging on a front face of the membrane, and wherein the front face of the membrane opens to the back volume chamber and a back face of the membrane opens to, and is spaced a distance from, an opening to an air passage through the earphone housing to the atmosphere.

2. The earphone of claim 1 wherein the membrane provides acoustic mass loading in that low frequency response of the driver is extended as compared to when the membrane is absent.

3. The earphone of claim 1 wherein the membrane exhibits a lowest normal vibration mode between 20 Hz-100 Hz.

4. The earphone of claim 1 wherein the membrane comprises a stiff central section and a flexible annular section, wherein the flexible annular section is fixed, along its entire periphery, to a wall of the back volume chamber, and allows the central section to vibrate.

5. The earphone of claim 4 wherein the membrane exhibits a lowest normal vibration mode between 20 Hz-100 Hz.

6. The earphone of claim 1 wherein the membrane is fixed, along its entire periphery, to a rigid wall of the back volume chamber.

7. The earphone of claim 1 wherein the membrane is substantially circular.

8. The earphone of claim 1 wherein the in-ear earphone housing is designed for a loose fit while partially inside the user's ear canal.

9. The earphone of claim 1 further comprising an acoustic tuning vent formed in a wall of the back volume chamber to communicate with the atmosphere.

10. The earphone of claim 1 further comprising an acoustic network acoustically open to a rear face of the membrane.

11. The earphone of claim 10 wherein the acoustic tuning network comprises an acoustic tuning mesh that also serves to protect the membrane from intrusions outside of the housing.

12. The earphone of claim 1 wherein a cross section area along the entirety of an air path that connects the diaphragm to the membrane is no smaller than ten percent of the total vibrating surface area of the membrane.

13. An earphone comprising:

an earphone housing having a rigid housing wall;

a speaker driver in the housing, the driver having a compliant diaphragm;

a back volume chamber open to a rear face of the diaphragm;

a front volume chamber open to a front face of the diaphragm; and a compliant membrane that is part of a wall of the back volume chamber, and wherein the compliant membrane is attached along its periphery to an inner surface of the rigid housing wall, and a portion of the back volume chamber between the rear face of the diaphragm and the compliant membrane is a completely uninterrupted open space.

14. The earphone of claim 13 wherein the membrane exhibits a lowest normal vibration mode between 20 Hz-100 Hz.

15. The earphone of claim 13 wherein the membrane provides acoustic mass loading in that low frequency response of the driver is extended as compared to when the membrane is absent.

16. The earphone of claim 13 wherein the membrane is attached, along its entire periphery, to the inner surface of the rigid housing wall.

17. The earphone of claim 13 wherein the earphone housing is designed for a loose fit while partially inside the user's ear canal.

18. An earphone comprising:

an in-ear earphone housing having a sound outlet port;

a speaker driver installed in the housing, the driver having a diaphragm with a front face and a rear face, and a motor to vibrate the diaphragm in accordance with an audio signal;

a back volume chamber within the earphone housing, wherein the rear face of the diaphragm is part of a wall of the back volume chamber;

a front volume chamber within the earphone housing, wherein the front face of the diaphragm opens to the front volume chamber and the front volume chamber is acoustically coupled to the sound outlet port; and an acoustic mass loading membrane that is part of another wall of the back volume chamber and that is to vibrate in response to acoustic waves, produced by vibration of the rear face of the diaphragm, impinging on a front face of the membrane, and wherein the front face of the membrane opens to the back volume chamber and a back face of the membrane opens to an air passage through the earphone housing to the atmosphere, and the membrane is airtight.

* * * * *